US010470262B2

(12) United States Patent
Li

(10) Patent No.: US 10,470,262 B2
(45) Date of Patent: Nov. 5, 2019

(54) ELECTRICAL CIRCUIT AND CONTROL METHOD REMOTELY CONTROLLING LED BRIGHTNESS ADJUSTMENT AND COLOR TEMPERATURE ADJUSTMENT

(71) Applicants: Osamu Murakami, Nishiwaki, Hyogo (JP); Toshio Murakami, Nishiwaki, Hyogo (JP); Taku Murakami, Hatano, Kanagawa (JP)

(72) Inventor: Shu Li, Dongguan (CN)

(73) Assignees: Osamu Murakami, Hyogo (JP); Toshio Murakami, Hyogo (JP); Taku Murakami, Kanagawa (JP)

( * ) Notice: Subject to any disclaimer, the term of this patent is extended or adjusted under 35 U.S.C. 154(b) by 0 days.

(21) Appl. No.: 16/254,051

(22) Filed: Jan. 22, 2019

(65) Prior Publication Data

US 2019/0230760 A1 Jul. 25, 2019

(30) Foreign Application Priority Data

Jan. 24, 2018 (JP) ..... 2018-009710

(51) Int. Cl.
*H05B 33/08* (2006.01)
*H05B 37/02* (2006.01)

(52) U.S. Cl.
CPC ..... *H05B 33/0818* (2013.01); *H05B 33/0854* (2013.01); *H05B 33/0863* (2013.01); *H05B 37/0272* (2013.01)

(58) Field of Classification Search
None
See application file for complete search history.

(56) References Cited

U.S. PATENT DOCUMENTS

| | | | | |
|---|---|---|---|---|
| 2010/0219758 | A1* | 9/2010 | Melzner | F21K 9/00 315/113 |
| 2013/0147360 | A1* | 6/2013 | Kang | H05B 37/02 315/122 |
| 2016/0374175 | A1* | 12/2016 | Koo | H05B 37/0218 |
| 2016/0374176 | A1 | 12/2016 | Van Der Poel | |
| 2017/0265266 | A1* | 9/2017 | Murray | H05B 33/0818 |
| 2017/0321849 | A1* | 11/2017 | Xiong | F21V 3/061 |

FOREIGN PATENT DOCUMENTS

| | | |
|---|---|---|
| JP | 2004-111104 | 4/2004 |
| JP | 2011-070880 | 4/2011 |
| JP | 2012-186183 | 9/2012 |
| JP | 2012-209274 | 10/2012 |

* cited by examiner

*Primary Examiner* — Douglas W Owens
*Assistant Examiner* — Syed M Kaiser
(74) *Attorney, Agent, or Firm* — Norris McLaughlin, P.A.

(57) ABSTRACT

The invention is to provide an electrical circuit and a control method remotely controlling LED brightness adjustment and color temperature adjustment, and the electrical circuit includes a voltage stabilizing circuit, a microprocessor MCU, a receiving module, an LED constant current driving circuit, an LED light adjustment and color temperature adjustment separation circuit, a bicolor temperature LED light source and system processing software.

10 Claims, 10 Drawing Sheets

FIG. 4

| | | |
|---|---|---|
| | ALL Light | ON/OFF |
| 1 | ALL White | Night LED |
| 2 | | |
| 3 | White+ | Dimmer+ |
| | Yellow+ | Dimmer- |
| | ALL Yellow | Memory |

ELECTRICAL CIRCUIT AND CONTROL METHOD REMOTELY CONTROLLING LED BRIGHTNESS ADJUSTMENT AND COLOR TEMPERATURE ADJUSTMENT

BACKGROUND OF THE INVENTION

1. Field of the Invention

The present invention relates to a method for controlling illumination light, and more specifically, to an electrical circuit and a control method remotely controlling LED brightness adjustment and color temperature adjustment.

2. Description of the Related Art

With the development of science and technology, the living quality of people is improved. Nowadays, a light control switch fixed to a wall no longer meets the demands for the use of people. Along with the widespread use of LEDs, the demands for light color temperature are increasing, and unchanged color temperature also fails to meet the demands for the living quality of people. In the related art, as shown in FIG. 1, resistors R12, R14, and R16, capacitors C12 and C13, a diode D2, an MOS tube Q6, an inductance L2, and a chip U7 constitute one constant current source (31) to drive a YLED1 having a yellow light 2700 K color temperature in a bicolor temperature LED light source (32). Resistors R13, R15, and R17, capacitors C14 and C15, a diode D3, an MOS tube Q7, an inductance L3, and a chip U8 constitute another constant current source (33) to drive a WLED1 having a white light 6500 K color temperature in the bicolor temperature LED light source (32). Signals received by a receiving module (29) are transmitted to a microprocessor (30). After the microprocessor (30) decodes the signals, two sets of light adjustment signals YPWM and WPWM are transmitted to the constant current source (31) and the constant current source (33) respectively to perform light adjustment and color temperature adjustment, so as to realize brightness adjustment and color temperature adjustment. However, this design method has the following two problems. First, a problem of maximizing a single color temperature output power. For example, when a fixed maximum output power of a lamp is 50 W, a yellow light YLED and a white light WLED both have a maximum output power of 25 W. Therefore, no matter how a duty ratio of the WPWM signal or the YPWM signal is adjusted, an output power of 50 W cannot be realized for a single color temperature. Second, when it is desired to adjust the brightness of a light without changing a color temperature thereof, both the color temperature and the brightness should be adjusted by controlling the two constant current sources due to the presence of the driving of the two constant current sources. Therefore, when the brightness (power) is changed, the color temperature also changes, making an operable range of the color temperature small. Thus, it is very difficult to realize the entire process.

In a time (nowadays) when the smart home application is very popular, it is apparently that the above product based on the above light control model is difficult to be widely spread or applied.

SUMMARY OF THE INVENTION

An object of the invention is to provide an electrical circuit and a control method remotely controlling LED brightness adjustment and color temperature adjustment, which are realized by using a microprocessor as a decoder, using wireless as a communication propagation medium, combining a system processing software with hardware including an LED constant current driving circuit, an LED light adjustment and color temperature adjustment separation circuit and a bicolor temperature LED light source, and setting a program. In the electrical circuit and the control method remotely controlling the LED brightness adjustment and color temperature adjustment, signals are transmitted by operating a transmitter according to needs of users, and information such as an address of a lamp, and a state control code of the lamp is set to realize wireless remote control on functions such as ON or OFF of LED light, brightness adjustment, color temperature adjustment, and a state storage.

A technical solution adopted in the invention relates to, an electrical circuit and a control method remotely controlling LED brightness adjustment and color temperature adjustment, the electrical circuit including a transmitter and a receiver, wherein the transmitter is provided with operation buttons of ALL Light, ON/OFF, ALL White, Night LED, White+, Yellow+, ALL Yellow, Dimmer+, Dimmer− and Memory, and buttons of address three-stage toggle switches 1, 2, and 3, wherein the receiver includes a receiving module (1), a microprocessor MCU (2), an LED constant current driving circuit (3), an LED light adjustment and color temperature adjustment separation circuit (4), a bicolor temperature LED light source (5), a voltage stabilizing circuit (6), information processing software hardwareized in the microprocessor MCU (2), and related data stored in an EEROM memory in the microprocessor MCU (2), wherein connection relations of hardware in the receiver are as follows:

the voltage stabilizing circuit (6) provides a stabilized operating voltage to the receiving module (1) and the microprocessor MCU (2); the receiving module (1) receives a signal and transmits the signal to the microprocessor MCU (2); the microprocessor MCU (2) transmits a brightness adjustment PWM signal and a color temperature adjustment PWM signal, transmits the brightness adjustment PWM signal to the LED constant current driving circuit (3), and transmits the color temperature adjustment PWM signal to the LED light adjustment and color temperature adjustment separation circuit (4); the LED constant current driving circuit (3) outputs a positive electrode current, the positive electrode current is divided into two channels by the LED light adjustment and color temperature adjustment separation circuit (4), a current of one channel is transmitted to a YLED positive electrode YLED+, and a current of the other channel is transmitted to a WLED positive electrode WLED+; the bicolor temperature LED light source (5) includes a common cathode of a white light 6500 K color temperature WLED and a yellow light 2700 K color temperature YLED; and an output negative electrode of the LED constant current driving circuit (3) is connected to an LED common cathode, wherein control steps of the transmitter and the receiver are as follows:

selecting an address toggle switch in the transmitter; pressing the Night LED button on the transmitter for 10 seconds to transmit an address code signal; and setting a same address code for the receiver and the transmitter as a condition for the transmitter to control the receiver, to realize a pair control of the transmitter with respect to the receiver, wherein a light (brightness) adjustment method is as follows: operating the ALL Light or the ON/OFF on the transmitter to perform lighting up; operating the Dimmer+ button or the Dimmer− button; receiving a signal and transmitting the signal to the microprocessor MCU (2) by the receiving module (1); after decoding the signal by the microprocessor MCU (2), transmitting a light adjustment PWM signal to the LED constant current driving circuit (3), to control a magnitude of a current of a lamp, that is, control the brightness; and determining a constant output power of the lamp based on the brightness adjustment PWM signal, independent of a color temperature adjustment WPWM signal and a color temperature adjustment YPWM signal, and wherein a color temperature adjustment method is as follows: operating the ALL Light or the ON/OFF on the transmitter to perform lighting up; operating the White+ button or the Yellow+ button; receiving a signal and transmitting the signal to the microprocessor MCU (2) by the receiving module (1); after decoding the signal by the microprocessor MCU (2), transmitting a color temperature adjustment PWM signal to the LED light adjustment and color temperature adjustment separation circuit (4); distributing, by the LED light adjustment and color temperature adjustment separation circuit (4), a current output from the LED constant current driving circuit (3) to a YLED lamp and a WLED lamp according to a request and mixing YLED light and WLED light, to control an output color temperature of the lamp without changing an output power; and operating the ALL White button or the ALL Yellow button, to realize a single color temperature operation with a maximum power.

In the control method remotely controlling the LED brightness adjustment and color temperature adjustment, the microprocessor MCU (2) performing decoding and transmits the brightness adjustment PWM signal and the color temperature adjustment PWM signal; the color temperature adjustment PWM signal includes the WPWM signal and the YPWM signal; the brightness adjustment PWM signal determines the constant output power of the lamp, independent of the color temperature adjustment WPWM signal and the color temperature adjustment YPWM signal; the color temperature adjustment YPWM signal and the color temperature adjustment WPWM signal determine a value of the output color temperature, independent of a magnitude of the power; the color temperature adjustment YPWM signal and the color temperature adjustment WPWM signal are reverse complementary signals; and the color temperature adjustment YPWM signal and the color temperature adjustment WPWM signal are synchronized with the brightness adjustment PWM signal.

In the electrical circuit remotely controlling the LED brightness adjustment and color temperature adjustment, the receiving module (1) includes an infrared receiving module and a wireless receiving module.

The electrical circuit remotely controlling the LED brightness adjustment and color temperature adjustment includes the microprocessor MCU (2), the LED constant current driving circuit (3), the LED light adjustment and color temperature adjustment separation circuit (4), and the bicolor temperature LED light source (5), wherein (a) the microprocessor MCU (2) includes a capacitor C2 and a U3 microcontroller PIC16F1824, the PIC16F1824 is a microcontroller including a 2-channel PWM, a clock, and an EEROM, and the PIC16F1824 microcontroller receives a control signal, transmits the color temperature adjustment PWM signal with one channel, and transmits the brightness adjustment PWM signal with the other channel;

(b) the LED constant current driving circuit (3) includes capacitors C5 and C6, resistors R1, R2 and R3, an inductance L1, a diode D1, an MOS tube Q1, and a chip U4, the LED constant current driving circuit (3) receives the brightness adjustment PWM signal transmitted by the microprocessor MCU (2), an output VLED+ end of the LED constant current driving circuit (3) is connected to source electrodes of P channel MOS tubes Q4 and Q5 in the LED light adjustment and color temperature adjustment separation circuit (4), and an output LEDWY− end is connected to the common cathode of the WLED and the YLED;

(c) the LED light adjustment and color temperature adjustment separation circuit (4) includes capacitors C7 and C8, resistors R4, R5, R6, R7, R8, R9, R10, and R11, transistors Q2 and Q3, an inverter U5, and the P channel MOS tubes Q4 and Q5, the LED light adjustment and color temperature adjustment separation circuit (4) receives the color temperature adjustment PWM signal transmitted by the microprocessor MCU (2), the color temperature adjustment PWM signal on one channel is buffered by the resistor R4 to obtain a white light color temperature adjustment WPWM signal, the color temperature adjustment WPWM signal is transmitted to a WLED lamp current distributor including the capacitor C7, the resistors R5, R7, and R8, the transistor Q2, and the P channel MOS tube Q4 to control a WLED lamp, the color temperature adjustment PWM signal on the other channel is inverted by the inverter U5 and buffered by the resistor R9 to obtain a yellow light color temperature adjustment YPWM signal, and the color temperature adjustment YPWM signal is transmitted to a current distributor including the capacitor C8, the resistors R6, R10, and R11, the transistor Q3 and the P channel MOS tube Q5 to control a YLED lamp; and (d) the bicolor temperature LED light source (5) includes the white light 6500 K color temperature WLED and the yellow light 2700 K color temperature YLED, the WLED and the YLED have the common cathode, the cathode is defined as LEDWY− and connected to the inductance L1 in the LED constant current driving circuit (3), and anodes of the WLED and the YLED are respectively connected to drains of the P channel MOS tubes Q4 and Q5 in the LED light adjustment and color temperature adjustment separation circuit (4).

In the electrical circuit and the control method remotely controlling the LED brightness adjustment and color temperature adjustment, control software hardwareized in the microprocessor MCU (2) includes an address setting subprogram (7), a main program module (8), a brightness and color temperature storage subprogram (9), a decoding and receiving subprogram (10), an interrupt processing subprogram (11), a code processing subprogram (12), and a brightness adjustment and color temperature adjustment PWM processing subprogram (13).

Connection relations in a system operation software module hardwareized in the microprocessor MCU (2) in the receiver are as follows:

the main program module (8) communicates with the address setting subprogram (7), the brightness and color temperature storage subprogram (9), and the interrupt processing subprogram (11); and the main program module (8) directly communicates with the decoding and receiving subprogram (10), the code processing subprogram (12), and the brightness adjustment and color temperature adjustment PWM processing subprogram (13).

Operating steps of software hardwareized in the microprocessor MCU (2) in the receiver are as follows:

performing a system initialization step (step 13), moving to a step (step 14) to read data from the EEROM and determine whether a brightness color temperature value is stored, when the brightness color temperature value is stored, moving to a step (step 28) to transmit the brightness adjustment PWM signal and the color temperature adjustment PWM signal according to the data read from the EEROM, and then to move to a step (step 16) to call a receiving subprogram, and when the brightness color temperature value is not stored, moving to a step (step 15) to light up all the lamps (W lamp 50% brightness+Y lamp 50% brightness), and then to move to a step (step 16) to call a receiving subprogram;

moving to a step (step 17) to determine whether there is a code, when there is no code, returning to the step to call the receiving subprogram (step 16), and when there is a code, moving to a timer-on interruption step (step 26), and then moving to an interruption returning step (step 27);

moving to a decoding and receiving processing subprogram step (step 18), and then moving to a code processing subprogram step (step 19); and moving to a step (step 20) to determine whether an address can be set, when the address can be set, moving to an address setting subprogram and related data storage step (step 21) and then returning to the step (step 16) to call the receiving subprogram, and when the address cannot be set, moving to a step (step 24) to determine whether there is a brightness adjustment and color temperature adjustment code, when there is a code, moving to a brightness adjustment and color temperature adjustment PWM processing subprogram and related data storage step (step 22), and then returning to the step (step 16) to call the receiving subprogram, and when there is no code, moving to a step (step 25) to determine whether there is a code storing a current state of the lamp, when there is a code, moving to a step (step 23) to store related data of a current brightness color temperature, and then returning to the step (step 16) to call the receiving subprogram, and when there is no code, returning to the step (step 16) to call the receiving subprogram.

1. A method for setting address codes of the receiver and the transmitter is simple, intuitive and reliable.

2. Various states of the lamp including lamp brightness, color temperature, ON and OFF, state memory, and bed light are remotely controlled.

3. A problem that "it is not possible to adjust a single color temperature and brightness value to the maximum power" in the related art is solved.

4. A problem that "when the color temperature does not change, a value of the color temperature will not be affected when adjusting the brightness" in the related art is solved.

5. A problem that "when the brightness does not change, the output power value will not be affected when adjusting the color temperature" in the related art is solved.

6. A problem that "an operable range of the color temperature is small" in the related art is solved.

BRIEF DESCRIPTION OF THE DRAWINGS

FIG. 4 is a functional schematic diagram of buttons on a transmitter of the invention.

DESCRIPTION OF THE PREFERRED EMBODIMENTS

Hereinafter, the invention will be further described in conjunction with the drawings and specific embodiments.

Figure 1:
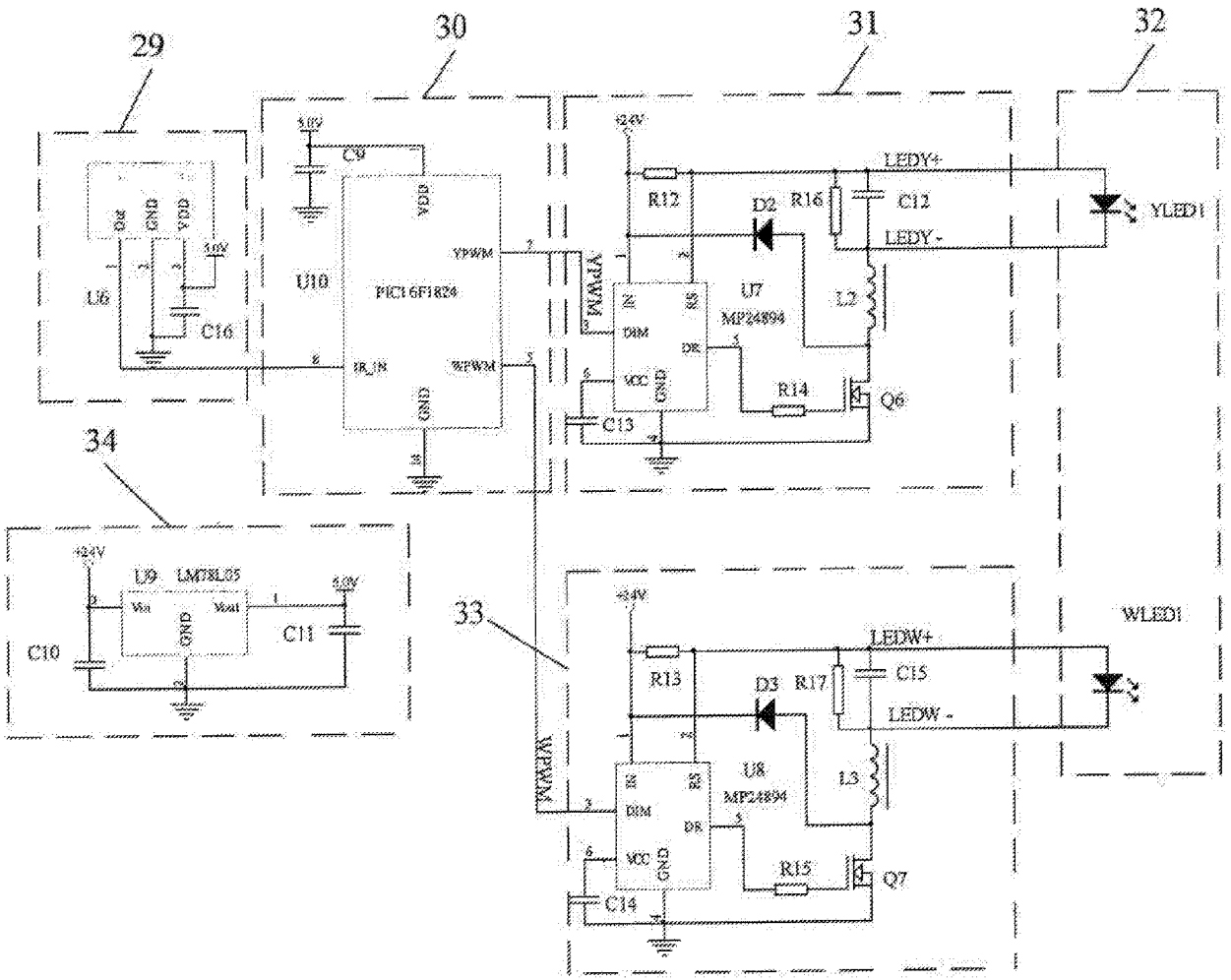
FIG. 1 is a structural diagram of an electrical circuit in the related art of the invention.

FIG. 1 is a structural diagram of an electrical circuit in the related art of the invention.

In the related art, as shown in FIG. 1, resistors R12, R14, and R16, capacitors C12 and C13, a diode D2, an MOS tube Q6, an inductance L2, and a chip U7 constitute one constant current source (31) to drive a YLED1 having a yellow light 2700 K color temperature in a bicolor temperature LED light source (32). Resistors R13, R15, and R17, capacitors C14 and C15, a diode D3, an MOS tube Q7, an inductance L3, and a chip U8 constitute another constant current source (33) to drive a WLED1 having a white light 6500 K color temperature in the bicolor temperature LED light source (32). Signals received by a receiving module (29) are transmitted to a microprocessor (30). After the microprocessor (30) decodes the signals, two sets of light adjustment signals YPWM and WPWM are transmitted to the constant current source (31) and the constant current source (33) respectively to perform light adjustment and color temperature adjustment, so as to realize brightness adjustment and color temperature adjustment. However, this design method has the following two problems. First, a problem of maximizing a single color temperature output power. For example, when a fixed maximum output power of a lamp is 50 W, a yellow light YLED and a white light WLED both have a maximum output power of 25 W. Therefore, no matter how a duty ratio of the WPWM signal or the YPWM signal is adjusted, an output power of 50 W cannot be realized for a single color temperature. Second, when it is desired to adjust the brightness of a light without changing a color temperature thereof, both the color temperature and the brightness should be adjusted by controlling the two constant current sources due to the presence of the driving of the two constant current sources. Therefore, when the brightness (power) is changed, the color temperature also changes, making an operable range of the color temperature small.

Figure 2:
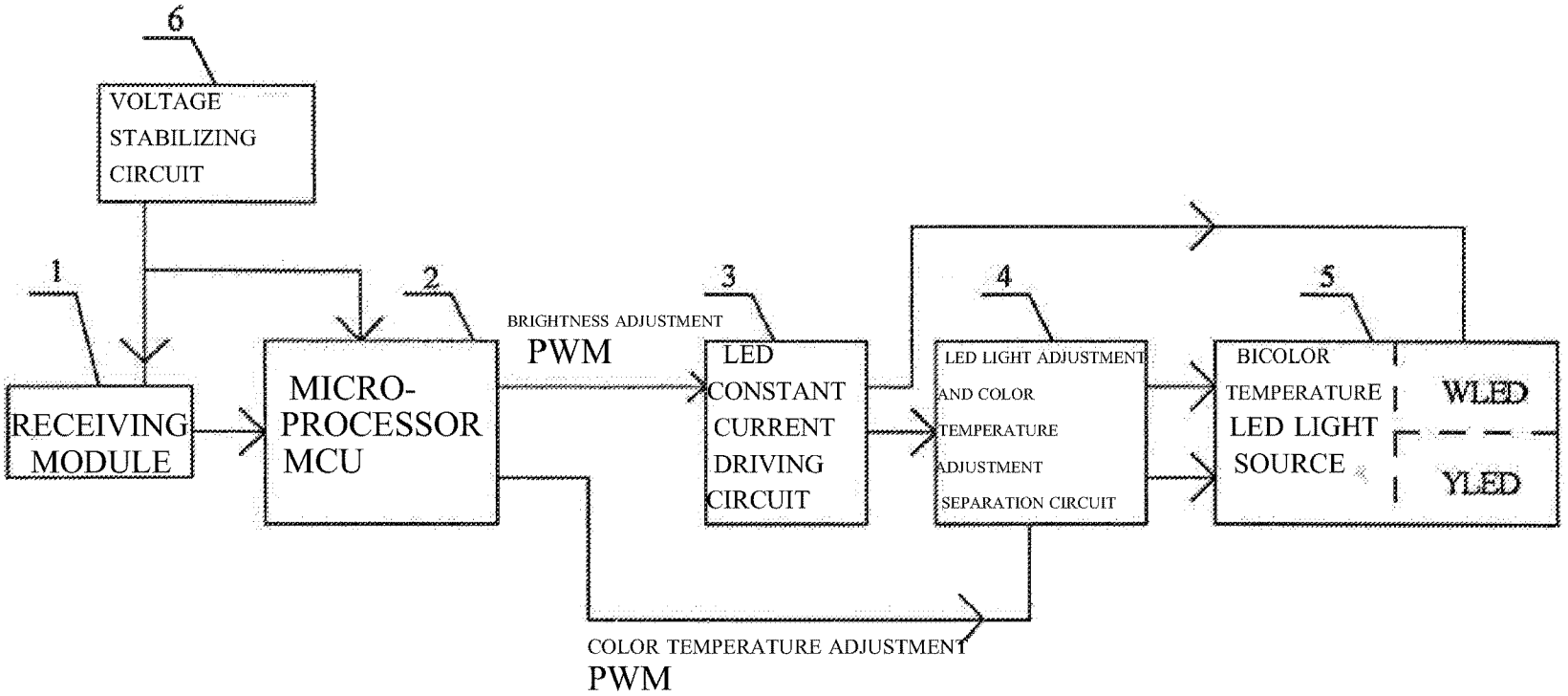
FIG. 2 is a principle block diagram of reception control hardware of the invention.

FIG. 2 is a principle block diagram of reception control hardware of the invention.

A receiver includes a receiving module (1), a microprocessor MCU (2), an LED constant current driving circuit (3), an LED light adjustment and color temperature adjustment separation circuit (4), a bicolor temperature LED light source (5), a voltage stabilizing circuit (6), information processing software hardwareized in the microprocessor MCU (2), and related data stored in an EEROM memory in the microprocessor MCU (2).

Connection relations of hardware in the receiver are as follows:

the voltage stabilizing circuit (6) provides a stabilized operating voltage to the receiving module (1) and the microprocessor MCU (2); the receiving module (1) receives a signal and transmits the signal to the microprocessor MCU (2); the microprocessor MCU (2) transmits a brightness adjustment PWM signal and a color temperature adjustment PWM signal, transmits the brightness adjustment PWM signal to the LED constant current driving circuit (3), and transmits the color temperature adjustment PWM signal to the LED light adjustment and color temperature adjustment separation circuit (4); the LED constant current driving circuit (3) outputs a positive electrode current, the positive electrode current is divided into two channels by the LED light adjustment and color temperature adjustment separation circuit (4), a current of one channel is transmitted to a YLED positive electrode YLED, and a current of the other channel is transmitted to a WLED positive electrode WLED; the bicolor temperature LED light source (5) includes a common cathode of a white light 6500 K color temperature WLED and a yellow light 2700 K color temperature YLED; and an output negative electrode of the LED constant current driving circuit (3) is connected to an LED common cathode.

Figure 3:
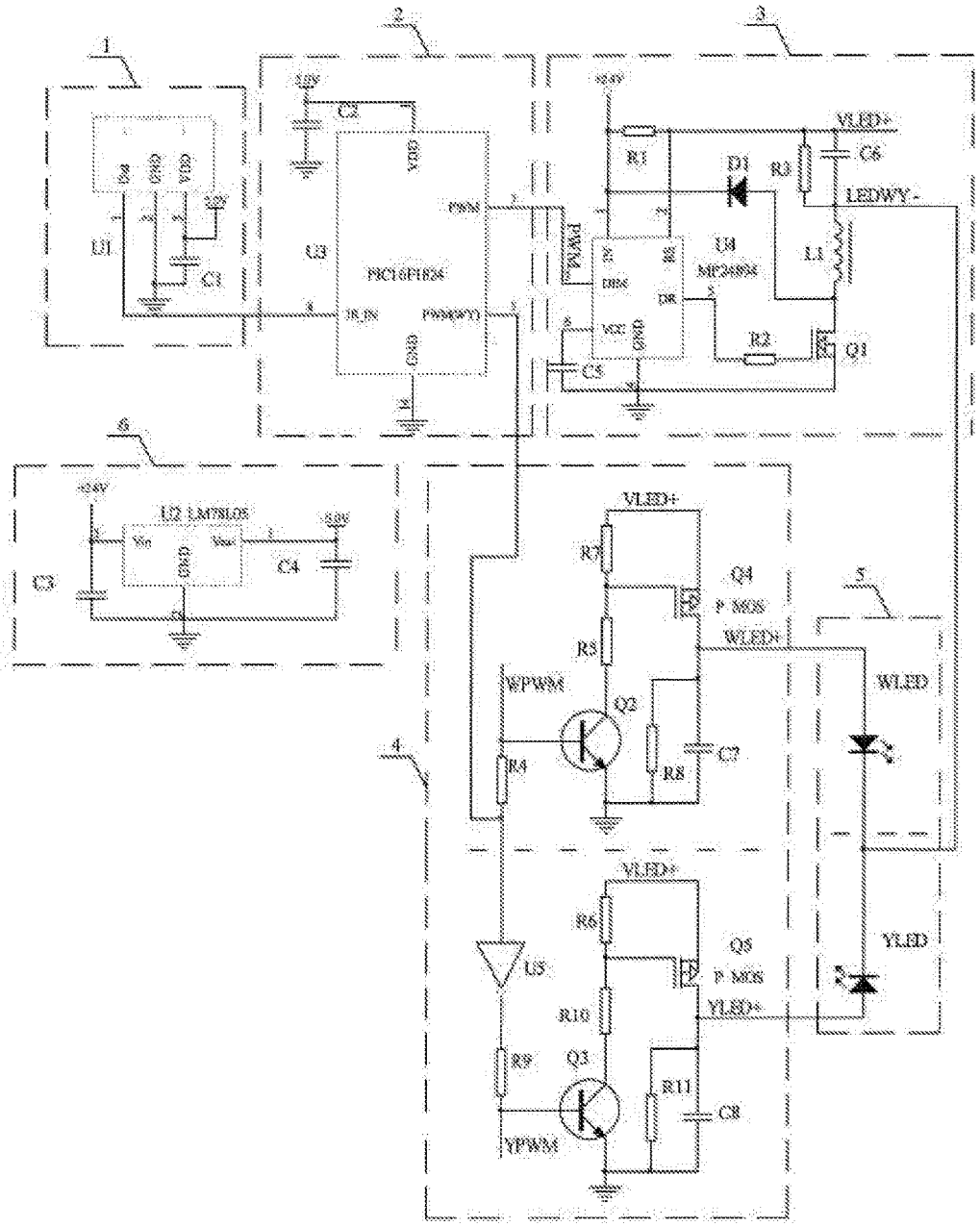
FIG. 3 is a principle diagram of hardware in a receiver of the invention.

FIG. 3 is a principle diagram of the hardware in the receiver of the invention.

In FIG. 3, an operation principle of the circuit is as follows. Capacitors C3 and C4 and U2 constitute the voltage stabilizing circuit (6), and the voltage stabilizing circuit (6) provides the stabilized operating voltage to the receiving module (1) and the microprocessor MCU (2). The invention is described with reference to an infrared receiving head. The receiving module (1) includes a capacitor C1 and an infrared receiving head U1, and the infrared receiving head U1 receives a signal and transmits the signal to the microprocessor MCU (2) for processing.

The microprocessor MCU (2) includes a capacitor C2 and a U3 microcontroller PIC16F1824, the PIC16F1824 is a microcontroller including a 2-channel PWM, a clock, and an EEROM, and the PIC16F1824 microcontroller receives a control signal, transmits the color temperature adjustment PWM signal with one channel, and transmits the brightness adjustment PWM signal with the other channel.

The LED constant current driving circuit (3) includes capacitors C5 and C6, resistors R1, R2 and R3, an inductance L1, a diode D1, an MOS tube Q1, and a chip U4, the LED constant current driving circuit (3) receives the brightness adjustment PWM signal transmitted by the microprocessor MCU (2), an output VLED+ end of the LED constant current driving circuit (3) is connected to Q4 and Q5 in the LED light adjustment and color temperature adjustment separation circuit (4), and an output LEDWY− end is connected to the common cathode of the WLED and the YLED.

The LED light adjustment and color temperature adjustment separation circuit (4) includes capacitors C7 and C8, resistors R4, R5, R6, R7, R8, R9, R10, and R11, transistors Q2 and Q3, an inverter U5, the P channel MOS tubes Q4 and Q5, the LED light adjustment and color temperature adjustment separation circuit (4) receives the color temperature adjustment PWM signal transmitted by the microprocessor MCU (2), the color temperature adjustment PWM signal on one channel is buffered by the resistor R4 to obtain a white light color temperature adjustment WPWM signal, the color temperature adjustment WPWM signal is transmitted to a WLED lamp current distributor including the capacitor C7, the resistors R5, R7, and R8, the transistor Q2, the P channel MOS tube Q4 to control a WLED lamp, the color temperature adjustment PWM signal on the other channel is inverted by the inverter U5 and buffered by the resistor R9 to obtain a yellow light color temperature adjustment YPWM signal, and the color temperature adjustment YPWM signal is transmitted to a current distributor including the capacitor C8, the resistors R6, R10, and R11, the transistor Q3 and the P channel MOS tube Q5 to control a YLED lamp.

The bicolor temperature LED light source (5) includes the white light 6500 K color temperature WLED and the yellow light 2700 K color temperature YLED, the WLED and the YLED have the common cathode, the cathode is defined as LEDWY− and connected to the inductance L1 in the LED constant current driving circuit (3), and anodes of the WLED and the YLED are respectively connected to drains of the P channel MOS tubes Q4 and Q5 in the LED light adjustment and color temperature adjustment separation circuit (4).

FIG. 4 is a functional schematic diagram of buttons on a transmitter of the invention.

"1", "2", and "3" shown on a left side of the FIG. 4 are three-stage address selection switches.

ON/OFF is an ON/OFF button of the lamp.

ALL Light is an operation button fora neutral light color temperature (that is, 4000 K color temperature, each of the YLED and the WLED lights up 50%).

ALL White is a maximum power single color white light operation button.

ALL Yellow is a maximum power single color yellow light operation button.

White+ is a white light color temperature increasing button.

Yellow+ is a yellow light color temperature increasing button.

Night LED is a multi-functional button and is an address setting button when pressed for a predetermined period of time, for example, about 10 seconds, and is a bed lamp ON/OFF button when pressed normally (within a predetermined time).

Dimmer+ is a brightness increasing adjustment button.

Dimmer− is a brightness decreasing adjustment button.

Memory is a storage button for a current state of the lamp. When the button is operated, the current state of the lamp, that is, a color temperature and brightness value is stored, so that the color temperature and brightness value is the stored value when performing lighting up with the ON/OFF or with a wall switch next time.

A light (brightness) adjustment method is as follows: operating the ALL Light or the ON/OFF on the transmitter to perform lighting up; operating the Dimmer+ button or the Dimmer− button; receiving a signal and transmitting the signal to the microprocessor MCU (2) by the receiving module (1); after decoding the signal by the microprocessor MCU (2), transmitting a light adjustment PWM signal to the LED constant current driving circuit (3), to control a magnitude of a current of a lamp, that is, control the brightness; and determining a constant output power of the lamp based on the brightness adjustment PWM signal, independent of a color temperature adjustment WPWM signal and a color temperature adjustment YPWM signal.

A color temperature adjustment method is as follows: operating the ALL Light or the ON/OFF on the transmitter to perform lighting up; operating the White+ button or the Yellow+ button; receiving a signal and transmitting the signal to the microprocessor MCU (2) by the receiving module (1); after decoding the signal by the microprocessor MCU (2), transmitting a color temperature adjustment PWM signal to the LED light adjustment and color temperature adjustment separation circuit (4); distributing, by the LED light adjustment and color temperature adjustment separation circuit (4), a current output from the LED constant current driving circuit (3) to a YLED lamp and a WLED lamp according to a request and mixing YLED light and WLED light, to control an output color temperature of the lamp without changing an output power; and operating the ALL White button or the ALL Yellow button, to realize a single color temperature operation with a maximum power.

The Night LED is a multi-functional button, and an address setting operation method is as follows:

selecting the toggle switch 1 on the left side of the transmitter to press the address setting button Night LED for the predetermined period of time, for example about 10 seconds; continuously transmitting, by the transmitter, N strings of address codes to the receiver; and after receiving the N strings of address codes, confirming, by the receiver, that this remote controller is a self-remote control remote controller. At this time, if the toggle switch 2 on the left side of the transmitter is selected, the lamp cannot be remotely controlled.

FIGS. 5A to 5D are relation diagrams of PWM transmitted in a brightness adjustment and color temperature adjustment process of the invention.

Figure 5A:
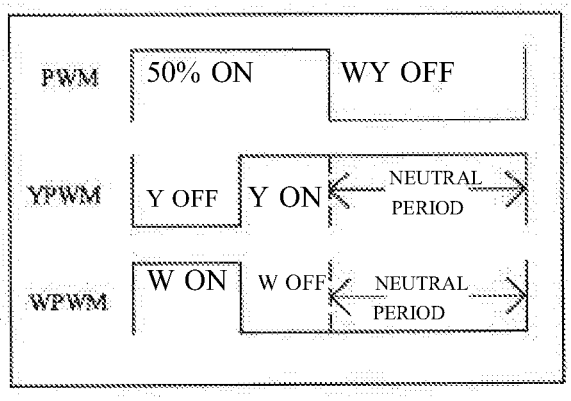
FIGS. 5A to 5D are relation diagrams of PWM transmitted in a brightness adjustment and color temperature adjustment process of the invention.

In FIG. 5A, when the duty ratio of the brightness adjustment PWM signal is 50% and the maximum output power of the lamp is 50 W, the output power of the lamp at this time is 25 W since the duty ratio of the brightness adjustment PWM signal is 50%. The color temperature adjustment YPWM signal and the color temperature adjustment WPWM signal are reversed and are synchronized with the brightness adjustment PWM signal. The light adjustment and color temperature adjustment separation circuit (4) distributes a current output from the LED constant current driving circuit (3) to the YLED lamp and the WLED lamp according to a request through the color temperature adjustment YPWM signal and the color temperature adjustment WPWM signal. Therefore, no matter how a distribution ratio of the duty ratio of the YPWM and the WPWM is adjusted, the set output power does not change and only the color temperature changes. In short, the brightness adjustment PWM signal determines the output power, the color temperature adjustment YPWM signal and the color temperature adjustment WPWM signal determine the output color temperature of the lamp. When the PWM signal has a low electrical level, the LED constant current driving circuit (3) does not output a current, and the WLED and the YLED are not lit up. At this time, the color temperature adjustment YPWM signal and the color temperature adjustment WPWM signal are in a neutral period.

Figure 5B:
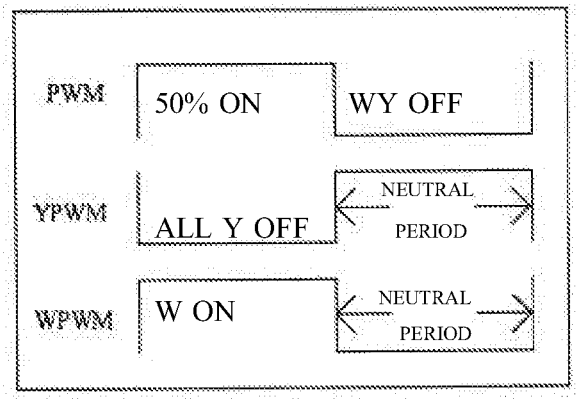

In FIG. 5B, the brightness adjustment PWM signal in FIG. 5A does not change and all the color temperature adjustment signals act on a white light WPWM signal. At this time, the output power of the lamp is 25 W for the white light WLED, while the yellow light YLED is not lit up.

Figure 5C:
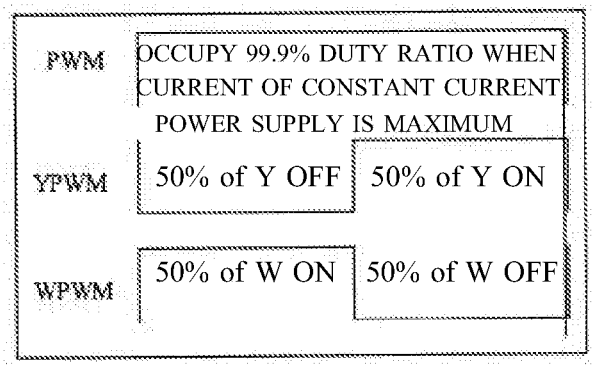

In FIG. 5C, the duty ratio of the brightness adjustment PWM signal is 99.9%, default to be 100%, and the color temperature adjustment YPWM signal and the color temperature adjustment WPWM signal each occupy a duty ratio of 50%. At this time, the output power of the lamp is 50 W. Since the color temperature adjustment YPWM signal and the color temperature adjustment WPWM signal each occupy a duty ratio of 50% separately, the color temperature of the lamp is 4000 K neutral color temperature. At this time, when the duty ratio of the brightness adjustment PWM signal is adjusted to 50%, waveforms of the YPWM, WPW, and PWM of this operation are operation waveforms in FIG. 5A, but the color temperature does not change, which is still 4000 K neutral color temperature. The ALL Light button in FIG. 4 is operated to obtain the waveforms in FIG. 5C.

Figure 5D:
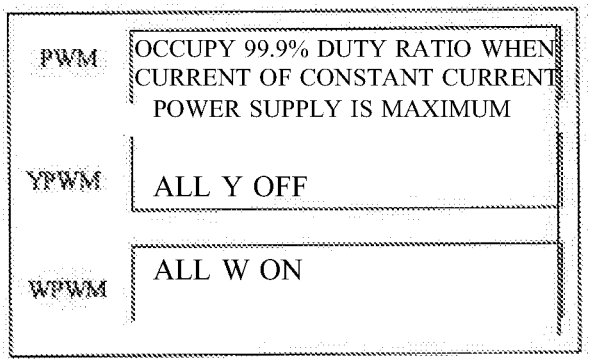

In FIG. 5D, the duty ratio of the brightness adjustment PWM signal is 99.9%, default to be 100%. At this time, the output power of the lamp is 50 W, the duty ratio of the color temperature adjustment YPWM signal is 0, and the duty ratio of the WPWM signal is 100%. At this time, the white light WLED has a maximum output power of 50 Wand a color temperature value of 6500 K, and the yellow light YLED has an output power of 0 and is lit off. A maximum adjustment of the single color temperature and brightness is realized as described above, and this waveform is obtained by operating the ALL White button in FIG. 4.

Figure 6:
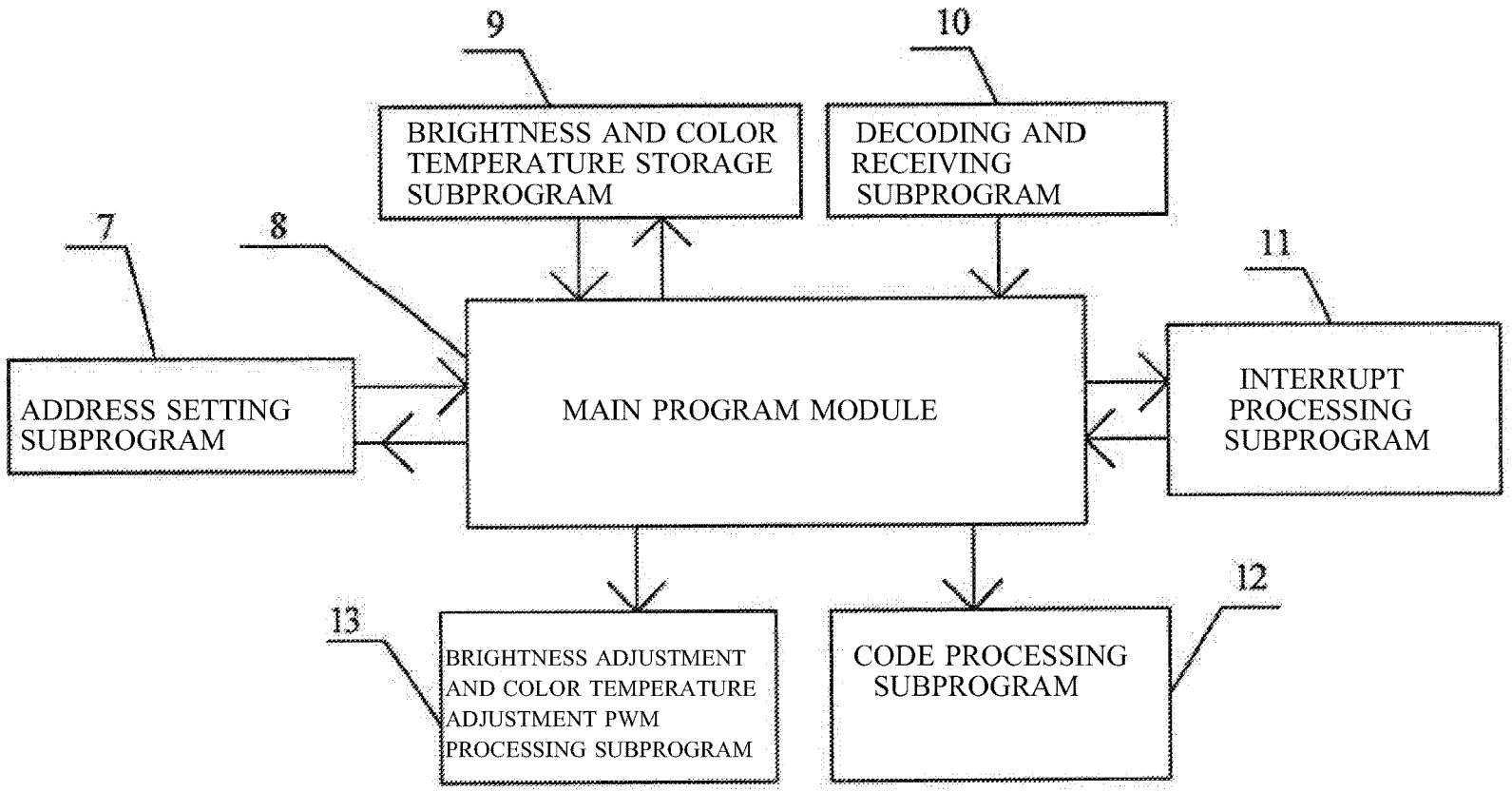
FIG. 6 is a principle diagram of system operation software hardwareized in a microprocessor MCU (2) in the receiver of the invention.

FIG. 6 is a principle diagram of system operation software hardwareized in the microprocessor MCU (2) in the receiver of the invention.

In the electrical circuit and the control method remotely controlling the LED brightness adjustment and color temperature adjustment, control software hardwareized in the microprocessor MCU (2) includes an address setting subprogram (7), a main program module (8), a brightness and color temperature storage subprogram (9), a decoding and receiving subprogram (10), an interrupt processing subprogram (11), a code processing subprogram (12), and a brightness adjustment and color temperature adjustment PWM processing subprogram (13).

Connection relations in a system operation software module hardwareized in the microprocessor MCU (2) in the receiver are as follows:

the main program module (8) communicates with the address setting subprogram (7), the brightness and color temperature storage subprogram (9), and the interrupt processing subprogram (11); and the main program module (8) directly communicates with the decoding and receiving subprogram (10), the code processing subprogram (12), and the brightness adjustment and color temperature adjustment PWM processing subprogram (13).

Figure 7:
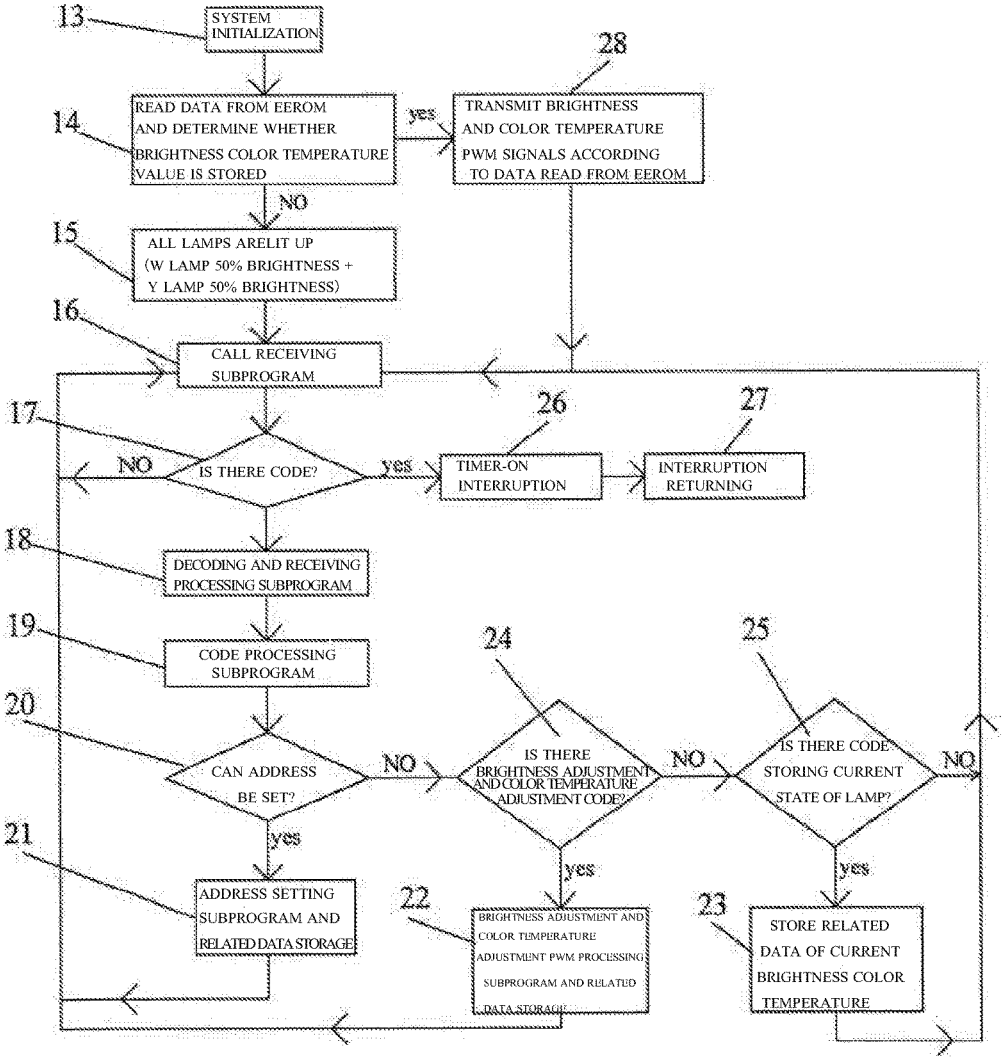
FIG. 7 is a software flowchart hardwareized in the microprocessor MCU (2) in the receiver of the invention.

FIG. 7 is a software flowchart hardwareized in the microprocessor MCU (2) in the receiver of the invention.

Operating steps of software hardwareized in the microprocessor MCU (2) in the receiver are as follows:

performing a system initialization step (step 13), moving to a step (step 14) to read data from the EEROM and determine whether a brightness color temperature value is stored, when the brightness color temperature value is stored, moving to a step (step 28) to transmit the brightness adjustment PWM signal and the color temperature adjustment PWM signal according to the data read from the EEROM, and then to move to a step (step 16) to call a receiving subprogram, and when the brightness color temperature value is not stored, moving to a step (step 15) to light up all the lamps (W lamp 50% brightness+Y lamp 50% brightness), and then to move to a step (step 16) to call a receiving subprogram;

moving to a step (step 17) to determine whether there is a code, when there is no code, returning to the step to call the receiving subprogram (step 16), and when there is a code, moving to a timer-on interruption step (step 26), and then moving to an interruption returning step (step 27);

moving to a decoding and receiving processing subprogram step (step 18), and then moving to a code processing subprogram step (step 19); and moving to a step (step 20) to determine whether an address can be set, when the address can be set, moving to an address setting subprogram and related data storage step (step 21) and then returning to the step (step 16) to call the receiving subprogram, and when the address cannot be set, moving to a step (step 24) to determine whether there is a brightness adjustment and color temperature adjustment code, when there is a code, moving to a brightness adjustment and color temperature adjustment PWM processing subprogram and related data storage step (step 22), and then returning to the step (step 16) to call the receiving subprogram, and when there is no code, moving to a step (step 25) to determine whether there is a code storing a current state of the lamp, when there is a code, moving to a step (step 23) to store related data of a current brightness color temperature, and then returning to the step (step 16) to call the receiving subprogram, and when there is no code, returning to the step (step 16) to call the receiving subprogram.

Although the invention was described with reference to the above embodiments, those skilled in the art will be able to clearly understand that the above embodiments are merely preferred examples of the invention, and it should be understood that various changes and modifications can be made in a broad sense without departing from the invention. Therefore, the invention is not limited, and as long as it is within a substantial idea of the invention, any of the above-described changes/modifications or modifications to the above-described implementation fall within the protection scope of claims of the invention.

DESCRIPTION OF REFERENCE NUMERALS AND SIGNS

1: Receiving module
2: Microprocessor MCU
3: LED constant current driving circuit
4: LED light adjustment and color temperature adjustment separation circuit
5: Bicolor temperature LED light source
6: Voltage stabilizing circuit
7: Address setting subprogram
8: Main program module
9: Brightness and color temperature storage subprogram
10: Decoding and receiving subprogram
11: Interrupt processing subprogram
12: Code processing subprogram
13 of FIG. 6: Brightness adjustment and color temperature adjustment PWM processing subprogram
13 of FIG. 7: System initialization
14: Read data from EEROM and determine whether brightness color temperature value is stored
15: All lamps are lit up (W lamp 50% brightness+Y lamp 50% brightness)
16: Call receiving subprogram
17: Is there code?
18: Decoding and receiving processing subprogram
19: Code processing subprogram
20: Can address be set?
21: Address setting subprogram and related data storage
22: Brightness adjustment and color temperature adjustment PWM processing subprogram and related data storage
23: Store related data of current brightness color temperature
24: Is there brightness adjustment and color temperature adjustment code?
25: Is there code storing current state of lamp?
26: Timer-on interruption
27: Interruption returning
28: Transmit brightness and color temperature PWM signals according to data read from EEROM

What is claimed is:

1. An electrical circuit remotely controlling LED brightness adjustment and color temperature adjustment, the electrical circuit comprising a transmitter and a receiver, wherein the transmitter is provided with operation buttons (ALL Light, ON/OFF, ALL White, Night LED, White+, Yellow+, ALL Yellow, Dimmer+, Dimmer− and Memory), and buttons of address three-stage toggle switches (1, 2, and 3), wherein the receiver includes a receiving module (1), a microprocessor MCU (2), an LED constant current driving circuit (3), an LED light adjustment and color temperature adjustment separation circuit (4), a bicolor temperature LED light source (5), a voltage stabilizing circuit (6), information processing circuitry in the microprocessor MCU (2), and related data stored in an EEROM memory in the microprocessor MCU (2), and wherein connection relations of hardware in the receiver are as follows:

the voltage stabilizing circuit (6) provides a stabilized operating voltage to the receiving module (1) and the microprocessor MCU (2); the receiving module (1) receives a signal and transmits the signal to the microprocessor MCU (2); the microprocessor MCU (2) transmits a brightness adjustment PWM signal and a color temperature adjustment PWM signal, transmits the brightness adjustment PWM signal to the LED constant current driving circuit (3), and transmits the color temperature adjustment PWM signal to the LED light adjustment and color temperature adjustment separation circuit (4); the LED constant current driving circuit (3) outputs a positive electrode current, the positive electrode current is divided into two channels by the LED light adjustment and color temperature adjustment separation circuit (4), a current of one channel is transmitted to a YLED positive electrode (YLED+), and a current of the other channel is transmitted to a WLED positive electrode (WLED+); the bicolor temperature LED light source (5) includes a common cathode of a white light 6500 K color temperature WLED and a yellow light 2700 K color temperature YLED; and an output negative electrode of the LED constant current driving circuit (3) is connected to an LED common cathode.

2. A control method remotely controlling LED brightness adjustment and color temperature adjustment, wherein a transmitter and a receiver are included, wherein the transmitter is provided with operation buttons (ALL Light, ON/OFF, ALL White, Night LED, White+, Yellow+, ALL Yellow, Dimmer+, Dimmer− and Memory), and buttons of address three-stage toggle switches (1, 2, and 3), wherein the receiver includes a receiving module (1), a microprocessor MCU (2), an LED constant current driving circuit (3), an LED light adjustment and color temperature adjustment separation circuit (4), a bicolor temperature LED light source (5), a voltage stabilizing circuit (6), information processing circuitry in the microprocessor MCU (2), and related data stored in an EEROM memory in the microprocessor MCU (2), wherein connection relations of hardware in the receiver are as follows:

the voltage stabilizing circuit (6) provides a stabilized operating voltage to the receiving module (1) and the microprocessor MCU (2); the receiving module (1) receives a signal and transmits the signal to the microprocessor MCU (2); the microprocessor MCU (2) transmits a brightness adjustment PWM signal and a color temperature adjustment PWM signal, transmits the brightness adjustment PWM signal to the LED constant current driving circuit (3), and transmits the color temperature adjustment PWM signal to the LED light adjustment and color temperature adjustment separation circuit (4); the LED constant current driving circuit (3) outputs a positive electrode current, the positive electrode current is divided into two channels by the LED light adjustment and color temperature adjustment separation circuit (4), a current of one channel is transmitted to a YLED positive electrode (YLED+), and a current of the other channel is transmitted to a WLED positive electrode (WLED+); the bicolor temperature LED light source (5) includes a common cathode of a white light 6500 K color temperature WLED and a yellow light 2700 K color temperature YLED; and an output negative electrode of the LED constant current driving circuit (3) is connected to an LED common cathode, wherein control steps of the transmitter and the receiver are as follows:

selecting an address toggle switch in the transmitter; pressing the Night LED button on the transmitter for 10 seconds to transmit an address code signal; and setting a same address code for the receiver and the transmitter as a condition for the transmitter to control the receiver, to realize a pair control of the transmitter with respect to the receiver, wherein a light (brightness) adjustment method is as follows:

operating the ALL Light or the ON/OFF on the transmitter to perform lighting up; operating the Dimmer+ button or the Dimmer− button; receiving a signal and transmitting the signal to the microprocessor MCU (2) by the receiving module (1); after decoding the signal by the microprocessor MCU (2), transmitting a light adjustment PWM signal to the LED constant current driving circuit (3), to control a magnitude of a current of a lamp, that is, control the brightness; and determining a constant output power of the lamp based on the brightness adjustment PWM signal, independent of a white light color temperature adjustment signal (WPWM) and a yellow light color temperature adjustment signal (YPWM), and wherein a color temperature adjustment method is as follows:

operating the ALL Light or the ON/OFF on the transmitter to perform lighting up; operating the White+ button or the Yellow+ button; receiving a signal and transmitting the signal to the microprocessor MCU (2) by the receiving module (1); after decoding the signal by the microprocessor MCU (2), transmitting a color temperature adjustment PWM signal to the LED light adjustment and color temperature adjustment separation circuit (4); distributing, by the LED light adjustment and color temperature adjustment separation circuit (4), a current output from the LED constant current driving circuit (3) to a YLED lamp and a WLED lamp according to a request and mixing YLED light and WLED light, to control an output color temperature of the lamp without changing an output power; and operating the ALL White button or the ALL Yellow button, to realize a single color temperature operation with a maximum power.

3. The control method remotely controlling the LED brightness adjustment and color temperature adjustment according to claim 2, wherein in the control method remotely controlling the LED brightness adjustment and color temperature adjustment, the microprocessor MCU (2) performs decoding and transmits the brightness adjustment PWM signal and the color temperature adjustment PWM signal; the color temperature adjustment PWM signal includes the WPWM signal and the YPWM signal; the brightness adjustment PWM signal determines the constant output power of the lamp, independent of the WPWM signal and the YPWM signal; the YPWM signal and the WPWM signal determine a value of the output color temperature, independent of a magnitude of the power; the YPWM signal and the WPWM signal are reverse complementary signals; and YPWM signal and the WPWM signal are synchronized with the brightness adjustment PWM signal.

4. The electrical circuit remotely controlling the LED brightness adjustment and color temperature adjustment according to claim 1, wherein in the electrical circuit remotely controlling the LED brightness adjustment and color temperature adjustment, the receiving module (1) includes an infrared receiving module and a wireless receiving module.

5. The electrical circuit remotely controlling the LED brightness adjustment and color temperature adjustment according to claim 1, wherein the electrical circuit remotely controlling the LED brightness adjustment and color temperature adjustment includes the microprocessor MCU (2) , the LED constant current driving circuit (3) , the LED light adjustment and color temperature adjustment separation circuit (4), and the bicolor temperature LED light source (5), wherein (a) the microprocessor MCU (2) includes a capacitor (C2) and a microcontroller (PIC16F1824) including a 2-channel PWM, a clock, and an EEROM, and the microcontroller receives a control signal, transmits the color temperature adjustment PWM signal with one channel, and transmits the brightness adjustment PWM signal with the other channel;

(b) the LED constant current driving circuit (3) includes capacitors (C5 and C6), resistors (R1, R2 and R3), an inductance (L1), a diode (D1), an MOS tube (Q1), and a chip (U4), the LED constant current driving circuit (3) receives the brightness adjustment PWM signal transmitted by the microprocessor MCU (2), an output end (VLED+) of the LED constant current driving circuit (3) is connected to source electrodes of P channel MOS tubes (Q4 and Q5) in the LED light adjustment and color temperature adjustment separation circuit (4), and an output end (LEDWY−) is connected to the common cathode of the WLED and the YLED;

(c) the LED light adjustment and color temperature adjustment separation circuit (4) includes capacitors (C7 and C8), resistors (R4, R5, R6, R7, R8, R9, R10, and R11), transistors (Q2 and Q3), an inverter (U5), and the P channel MOS tubes (Q4 and Q5), the LED light adjustment and color temperature adjustment separation circuit (4) receives the color temperature adjustment PWM signal transmitted by the microprocessor MCU (2) , the color temperature adjustment PWM signal on one channel is buffered by the resistor (R4) to obtain a white light color temperature adjustment signal (WPWM), the white light color temperature adjustment signal is transmitted to a WLED lamp current distributor including the capacitor (C7), the resistors (R5, R7, and R8), the transistor (Q2), and the P channel MOS tube (Q4) to control the WLED lamp, the color temperature adjustment PWM signal on the other channel is inverted by the inverter (U5) and buffered by the resistor (R9) to obtain a yellow light color temperature adjustment signal (YPWM), and the yellow light color temperature adjustment signal is transmitted to a current distributor including the capacitor (C8), the resistors (R6, R10, and R11), the transistor (Q3) and the P channel MOS tube (Q5) to control the YLED lamp; and (d) the bicolor temperature LED light source (5) includes the white light 6500 K color temperature WLED and the yellow light 2700 K color temperature YLED, the WLED and the YLED have the common cathode (LEDWY−) and connected to the inductance (L1) in the LED constant current driving circuit (3), and anodes of the WLED and the YLED are respectively connected to drains of the P channel MOS tubes (Q4 and Q5) in the LED light adjustment and color temperature adjustment separation circuit (4).

6. The electrical circuit remotely controlling the LED brightness adjustment and color temperature adjustment according to claim 1, wherein in the electrical circuit remotely controlling the LED brightness adjustment and color temperature adjustment, control circuitry in the microprocessor MCU (2) includes an address setting subprogram (7), a main program module (8), a brightness and color temperature storage subprogram (9) , a decoding and receiving subprogram (10) , an interrupt processing subprogram (11), a code processing subprogram (12), and a brightness adjustment and color temperature adjustment PWM processing subprogram (13).

7. The electrical circuit remotely controlling the LED brightness adjustment and color temperature adjustment according to claim 6, wherein connection relations in a system operation circuit in the microprocessor MCU (2) in the receiver are as follows: the main program module (8) communicates with the address setting subprogram (7) , the brightness and color temperature storage subprogram (9), and the interrupt processing subprogram (11); and the main program module (8) directly communicates with the decoding and receiving subprogram (10), the code processing subprogram (12), and the brightness adjustment and color temperature adjustment PWM processing subprogram (13).

8. The control method remotely controlling the LED brightness adjustment and color temperature adjustment according to claim 2, wherein operating steps of the microprocessor MCU (2) in the receiver are as follows:

performing a system initialization step (step 13), moving to a step (step 14) to read data from the EEROM and determine whether a brightness color temperature value is stored, when the brightness color temperature value is stored, moving to a step (step 28) to transmit the brightness adjustment PWM signal and the color temperature adjustment PWM signal according to the data read from the EEROM, and then to move to a step (step 16) to call a receiving subprogram, and when the brightness color temperature value is not stored, moving to a step (step 15) to light up all the lamps (W lamp 50% brightness +Y lamp 50% brightness) , and then to move to a step (step 16) to call a receiving subprogram;

moving to a step (step 17) to determine whether there is a code, when there is no code, returning to the step to call the receiving subprogram (step 16), and when there is a code, moving to a timer-on interruption step (step 26) , and then moving to an interruption returning step (step 27);

moving to a decoding and receiving processing subprogram step (step 18) , and then moving to a code processing subprogram step (step 19); and moving to a step (step 20) to determine whether an address can be set, when the address can be set, moving to an address setting subprogram and related data storage step (step 21) and then returning to the step (step 16) to call the receiving subprogram, and when the address cannot be set, moving to a step (step 24) to determine whether there is a brightness adjustment and color temperature adjustment code, when there is a code, moving to a brightness adjustment and color temperature adjustment PWM processing subprogram and related data storage step (step 22), and then returning to the step (step 16) to call the receiving subprogram, and when there is no code, moving to a step (step 25) to determine whether there is a code storing a current state of the lamp, when there is a code, moving to a step (step 23) to store related data of a current brightness color temperature, and then returning to the step (step 16) to call the receiving subprogram, and when there is no code, returning to the step (step 16) to call the receiving subprogram.

9. An electrical circuit remotely controlling LED brightness adjustment and color temperature adjustment, the electrical circuit comprising a transmitter and a receiver, wherein the transmitter is provided with operation buttons (ALL Light, ON/OFF, ALL White, Night LED, White+, Yellow+, ALL Yellow, Dimmer+, Dimmer− and Memory), and buttons of address three-stage toggle switches (1, 2, and 3), wherein the receiver includes a receiving module (1), a microprocessor MCU (2), an LED constant current driving circuit (3), an LED light adjustment and color temperature adjustment separation circuit (4), a bicolor temperature LED light source (5), a voltage stabilizing circuit (6), information processing circuitry in the microprocessor MCU (2), and related data stored in an EEROM memory in the microprocessor MCU (2), and wherein connection relations of hardware in the receiver are as follows:

the voltage stabilizing circuit (6) provides a stabilized operating voltage to the receiving module (1) and the microprocessor MCU (2); the receiving module (1) receives a signal and transmits the signal to the microprocessor MCU (2), the microprocessor MCU (2)

transmits a brightness adjustment PWM signal and a color temperature adjustment PWM signal, transmits the brightness adjustment PWM signal to the LED constant current driving circuit (3), and transmits the color temperature adjustment PWM signal to the LED light adjustment and color temperature adjustment separation circuit (4); the LED constant current driving circuit (3) outputs a positive electrode current, the positive electrode current is divided into two channels by the LED light adjustment and color temperature adjustment separation circuit (4), a current of one channel is transmitted to a YLED positive electrode (YLED+), and a current of the other channel is transmitted to a WLED positive electrode (WLED+); the bicolor temperature LED light source (5) includes a common cathode of a white light color temperature WLED and a yellow light color temperature YLED; and an output negative electrode of the LED constant current driving circuit (3) is connected to an LED common cathode.

10. A control method remotely controlling LED brightness adjustment and color temperature adjustment, wherein a transmitter and a receiver are included, wherein the electrical circuit remotely controlling the LED brightness adjustment and color temperature adjustment and including the transmitter and the receiver according to claim 9 is included, wherein control steps of the transmitter and the receiver are as follows:

selecting an address toggle switch on the transmitter; pressing a Night LED button on the transmitter for a certain period of time to transmit an address code signal; and setting a same address code for the receiver and the transmitter as a condition for the transmitter to control the receiver, to realize a pair control of the transmitter with respect to the receiver, wherein a light (brightness) adjustment method is as follows:

operating the ALL Light or the ON/OFF on the transmitter to perform lighting up; operating the Dimmer+ button or the Dimmer− button; receiving a signal and transmitting the signal to the microprocessor MCU (2) by the receiving module (1); after decoding the signal by the microprocessor MCU (2), transmitting a light adjustment PWM signal to the LED constant current driving circuit (3), to control a magnitude of a current of a lamp, that is, control the brightness; and determining a constant output power of the lamp based on the brightness adjustment PWM signal, independent of a color temperature adjustment WPWM signal and a color temperature adjustment YPWM signal, and, wherein a color temperature adjustment method is as follows:

operating the ALL Light or the ON/OFF on the transmitter to perform lighting up; operating the White+ button or the Yellow+ button; receiving a signal and transmitting the signal to the microprocessor MCU (2) by the receiving module (1); after decoding the signal by the microprocessor MCU (2), transmitting a color temperature adjustment PWM signal to the LED light adjustment and color temperature adjustment separation circuit (4); distributing, by the LED light adjustment and color temperature adjustment separation circuit (4), a current output from the LED constant current driving circuit (3) to a YLED lamp and a WLED lamp according to a request and mixing YLED light and WLED light, to control an output color temperature of the lamp without changing an output power; and operating the ALL White button or the ALL Yellow button, to realize a single color temperature operation with a maximum power.

* * * * *